US007073860B2

(12) United States Patent
Markus

(10) Patent No.: US 7,073,860 B2
(45) Date of Patent: Jul. 11, 2006

(54) RECLINABLE CHAIR MECHANISM

(76) Inventor: Isidoro Natalio Markus, 65-36 99 St (1E), Rego Park, NY (US) 11374-4363

( * ) Notice: Subject to any disclaimer, the term of this patent is extended or adjusted under 35 U.S.C. 154(b) by 0 days.

(21) Appl. No.: 10/816,716

(22) Filed: Apr. 5, 2004

(65) Prior Publication Data

US 2005/0006936 A1 Jan. 13, 2005

Related U.S. Application Data

(60) Provisional application No. 60/485,067, filed on Jul. 7, 2003.

(51) Int. Cl.
*A47C 1/024* (2006.01)
*A47C 1/12* (2006.01)
*A47C 3/02* (2006.01)

(52) U.S. Cl. ..... 297/316; 297/325; 297/340; 297/344.1; 297/258.1; 297/270.1; 297/272.1

(58) Field of Classification Search ..... 297/316, 297/325, 340, 344.1, 258.1, 264.1, 270.1, 297/272.1

See application file for complete search history.

(56) References Cited

U.S. PATENT DOCUMENTS

| | | | | |
|---|---|---|---|---|
| 4,842,232 | A * | 6/1989 | Pipon et al. | 248/344.1 X |
| 4,861,106 | A * | 8/1989 | Sondergeld | 297/316 |
| 4,957,302 | A * | 9/1990 | Maxwell | 297/325 X |
| 5,244,252 | A * | 9/1993 | Serber | 297/325 X |
| 5,522,182 | A * | 6/1996 | Rogers | 297/344.1 X |
| 5,558,399 | A * | 9/1996 | Serber | 297/343 X |
| 5,735,574 | A * | 4/1998 | Serber | 297/343 X |
| 6,056,363 | A * | 5/2000 | Maddox | 297/325 |
| 6,106,065 | A * | 8/2000 | Carroll | 297/325 X |
| 6,641,214 | B1 * | 11/2003 | Veneruso | 297/325 X |
| 2003/0011227 | A1 * | 1/2003 | Markus | 297/344.1 |

* cited by examiner

*Primary Examiner*—Rodney B. White

(57) ABSTRACT

A four legged or sled chair comprising a frame structure, a seat mounted between the frame structure and connected to it by sliding means. The sliding means comprising a plurality of runners attached to the seat and sliding therein circular ring sector slots located on the frame defining the virtual transverse axis of rotation and the stops of said seat thereto said frame.

6 Claims, 12 Drawing Sheets

RECLINABLE CHAIR MECHANISM

CROSS-REFERENCE TO OTHER PATENTS

The applicant claim priority of Disclosure Document # 531771 dated May 22, 2003 plus the Provisional Patent Application # 60/485,067 filed Jul. 7, 2003.

The present application is related to my U.S. Pat. No. 4,819,986 "Reclining chair with suspended seating"; my U.S. Pat. No. 4,880,273 "Reclining chair having suspended seating", and my Canadian Patent 2,002,009 "Reclining chair having suspended seating". These being the only known patents that refer specifically to four legged or sled chairs having a spring-less reclinable seating.

BACKGROUND OF THE INVENTION

In the patents mentioned above, the seating was supported by flexible members so as to enable it to rotate with respect to the chair frame, thereby enabling the user to vary his position from upright sitting to fully reclining sitting. A reclinable chair being more comfortable and healthier for its occupant.

Runners attached to the four corners of the seating board went through slots machined in the chair's frame whereby they attached to the ends of said flexible members. Each of the four slots where shaped like a circular sector, with the diameter of said sectors matching the distance between the front and the rear runners. Hence, the rotation of the seating was guided by the geometry of said slots. Expressly, the sliding of the runners over the edges of the slots controlled the motions of the seating.

Though the chairs having a suspended seating worked smoothly and effortlessly, the cumbersome mechanism and the aesthetic design constrains in the frame, needed to house said mechanism, were a big drawback. Another drawback was the impossibility to build an armless chair, since armrests were needed to house the mechanism, and used by the chair occupant to pull the seat forward from the reclined positions.

In the present invention—basically—the seat has plastic shoes or runners that slide over circular slots called here the raceways, that are attached to the frame. The sliding travel of the runners over the raceways defines the seat pivoting degree of rotation. Due to the nature of the sliding surfaces, all the motions are then smoothly and noiselessly attained.

But the most desirable characteristic of a non-powered reclinable seat should be its ability to rotate effortlessly over its whole arc of pivoting and to retain—also effortlessly—any attained seat position.

In the present invention this is achieved by the combination of two features:

a) By placing the center of rotation of the seat to the rear of the assumed center of gravity of the seat-occupant entirety, whenever the occupant tilts the seat back by pushing with his legs, it rises the center of gravity, hence, increasing the gravitational potential energy of the entirety. Thus, to bring the seat forward, the occupant just let go—intuitively—with his legs and gravity will bring the seat forward, effortlessly, up to its fully upright position, if wanted. And, b) By making the resistance to rotate the seat proportional to the occupant weight, we achieve a reclining chair that is friendly to everybody. No more having a small person finding the seat hard to rotate, or a heavy set person—supposedly physically stronger—finding the seat to easy to rotate, hence, unstable.

In view of the innovative advantages mentioned above, it is the principal object of the present invention to offer a chair mechanism whereby the seat slides over curved surfaces.

It is a further object to provide an armless chair having a reclinable seat.

Yet another object of this invention is to provide greater aesthetics freedom of design, reliability and easy of manufacturing.

SUMMARY OF THE INVENTION

The above and other beneficial objects and advantages over the state of the art, are attained in accordance with the present invention which comprises a chair frame and a seat disposed within.

The seat is supported and guided by circular slots attached to the frame; corresponding runners attached to the seat enable it to slide over the convex, or the concave, surfaces of the raceways. In following the raceways path, the runners rotate the seat from a fully upright to a fully reclinable position, and to all positions in within.

In another embodiment the runners are attached to the frame and the raceways are attached to the seat.

DETAILED DESCRIPTION OF THE PREFERRED EMBODIMENTS

Figure 1:
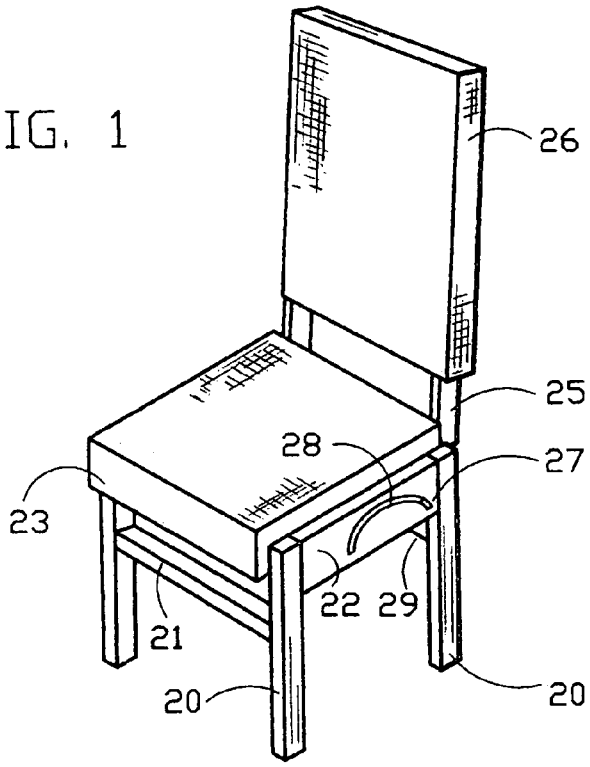
FIG. 1 is a schematic perspective view of a chair with the seat in an upright position.

Referring now in detail to FIG. 1, a side chair using the present invention comprises a supporting wooden frame incorporating two similar side frames, each built to provide a substantially horizontal member 22 and substantially vertical leg members 20. A front cross-rail 21, and a rear cross-rail 29 connect both side frames.

It will be understood that the hardware is symmetrically disposed on both side of the chair; hence, the hardware on one side only will be described in the future.

The seat comprises an upholstered horizontal board 23 and an upholstered back board 26, which are rigidly connected together to each other at an obtuse angle by the rails 25. This chair, having a reclinable seat, is built differently from the generic fixed chairs where the seat structure and the frame are rigidly connected at a plurality of places. Here the seat rotates, or pivots, within the chair frame, whereby the seat and frame are connect only through the components of the invented reclinable mechanism.

Notice on the horizontal member 22, a throughout machined circular ring sector 27 a slot called the raceway, that houses a corresponding male circular ring sector 28, called the runner. While the raceway 27 is part of the chair frame, the runner 28 is part of the seat. The inner sector 28 having a shorter arc could travels—oscillate—between the inner ends of the raceway. This free travel—an arc of about 14°—clearly defines the extent of the seat rotation, tilting or pivoting.

Figure 2:
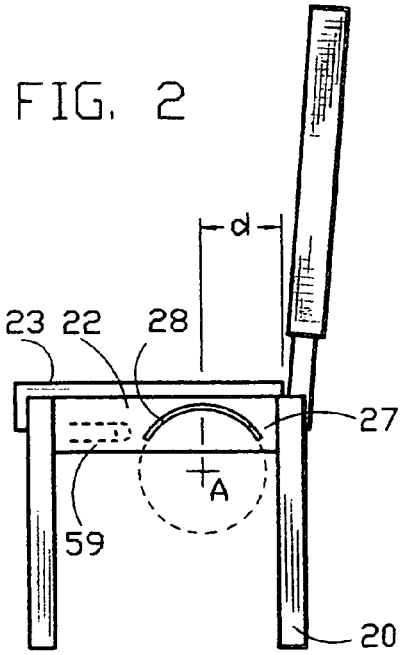
FIG. 2 is a schematic side elevation view of the chair shown in FIG. 1, with the seat in an upright position.

FIG. 2 is a chair similar to FIG. 1, showing a side elevational view of the seat in a fully upright position. Here, the front end of the runner 28 rest against the front inner end of raceway 27. The lower surface of the slot, also called the path because the runners always slide over that surface, is part of a circle having the same radio as the shown dashed lines circle with center on the cross-hair A.

The virtual (imaginary) transverse axis of the seat rotation would be a line passing through the cross-air A on both sides of the chair. The distance "d", measured horizontally between a plumb line passing through the center of rotation A and the rear edge of the bottom board 23 is usually 4" to 8" (four to eight inches), depending on the chair style and application. Since said center of gravity would vary widely, the value of "d" was settled after numerous diversified tests. In the present invention, the center of rotation is always (measured horizontally), behind the center of gravity of the seat-occupant entirety, to minimize the chair occupant effort necessary to tilt the seat forward. To avoid that the seat tilts backwards due to the weight of the back board, a weak torsion spring 59, connecting the side frame and the seat, will keep the seat in the upright position.

Figure 3:
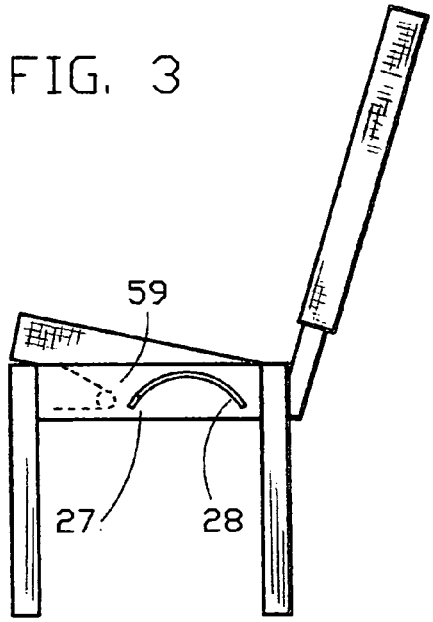
FIG. 3 is a view similar to FIG. 2, but showing the seat in a fully reclined position.

FIG. 3 is the same chair of FIG. 2 showing the seat in a fully reclinable position.

Notice here that the runner 28 has rotated all the way back, inside the raceway 27, until its rear end was stopped by the rear inner end of the raceway. 59 is the torsion spring.

Figure 4:
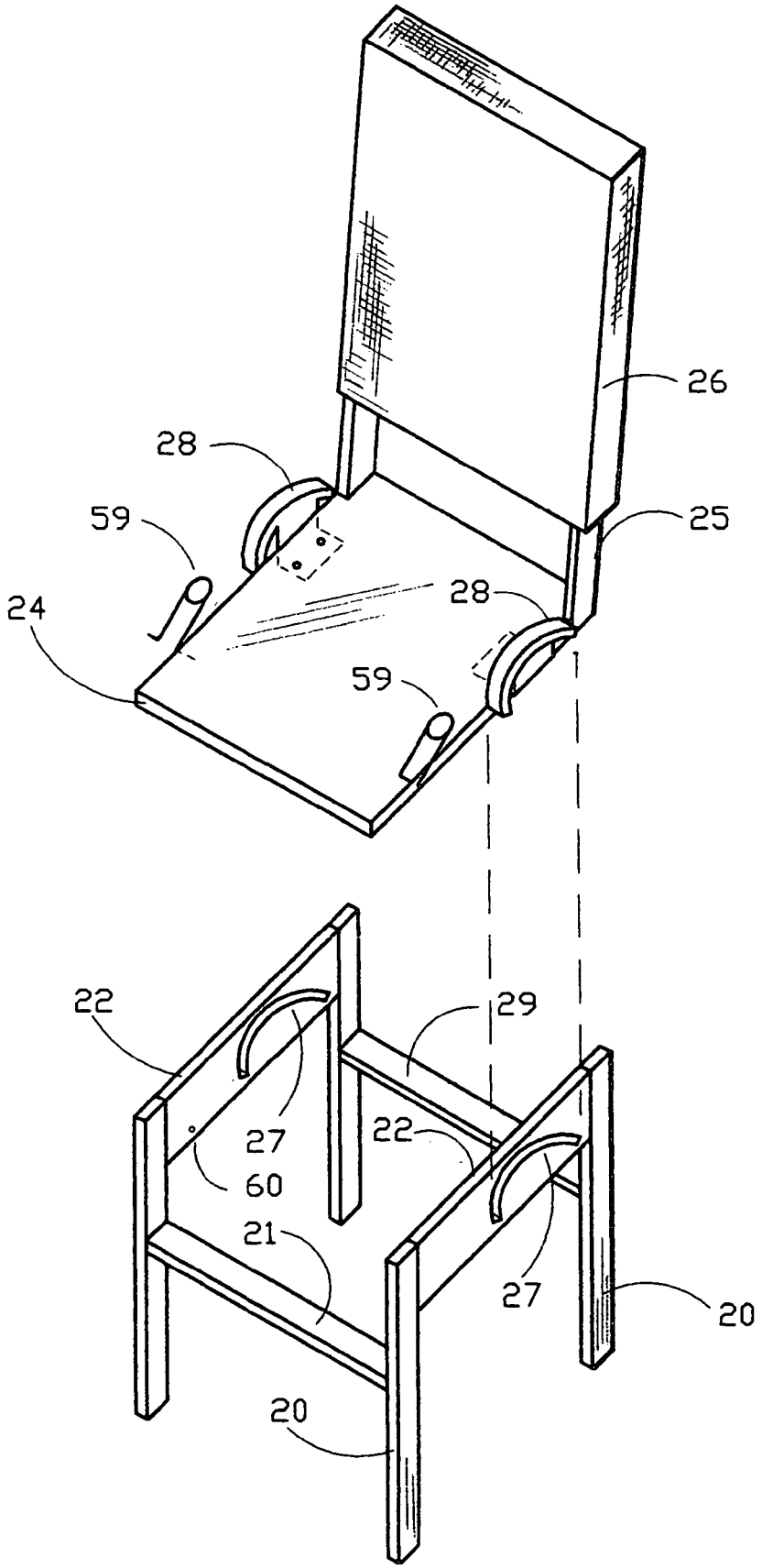
FIG. 4 is an exploded perspective view of the chair shown in FIG. 1.

FIG. 4 is a fragmentary exploded view of the chair of FIG. 1.

For clarity purposes only, the fabric and foam that comprises the upholstery horizontal board 23 has been removed, leaving in place an ubiquitous panel 24 that is the structural member of said board 23. 28 are the runners (right and left hand required), rigidly attached to panel 24. The runners could be made of a molded reinforced plastic, stamped out of a metallic sheet, machined from a cast or solid piece, etc. Or made by a combination of all of them. The matching cross section surfaces of the raceways and the runners are shown flat, but they could have other shapes. The raceway 27 that is shown here as a cutout on the wooden member 22 should have an inside plastic insert or metallic lining covering the wooden raceway surfaces. The insert or lining could be used to reinforce the wooden cutout, to reduce the sliding noise, to reduce wear and tear and/or to place small surface details on the raceways paths that would be impossible to duplicate in wood, etc. In other instances, a lining that could be a plastic tape or a metallic strip, embedded, glued or fastened over the raceway paths could be used to change its operation, because the dynamic sliding of a runner over a raceway path is very much given by the coefficient of friction between their mating surfaces.

Here, numeral 59 are a pair of elastic elements, torsion springs in this case that, anchored to the planar board 24 and to the side frame in hole 60, would force the seat against its upright position stops.

Figure 5:
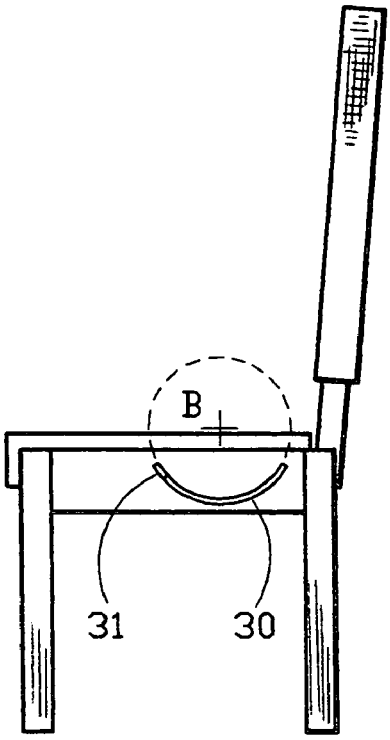
FIG. 5 is a view similar to FIG. 2, but illustrating the raceway in a different position.

FIG. 5 shows a chair similar of the chair depicted in FIG. 2, but having the runner 30 sliding over a concave raceway 31. In this layout the center of rotation is above the raceway, as shown by the cross-hair B.

The different placement of the center of rotation produce different motions on the seat. Other modes of seat rotation could be also created, if the raceway arc is not placed symmetrically to a plumb line passing through the center of rotation.

Figure 6:
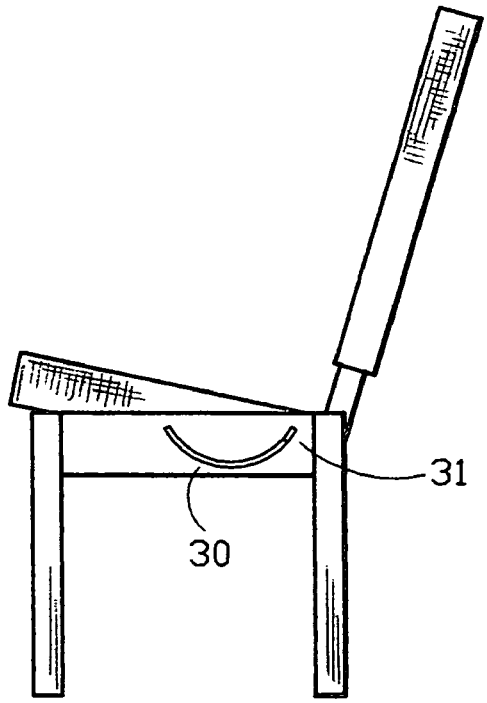
FIG. 6 is a view similar to FIG. 5, showing the seat in a fully reclined position.

FIG. 6 shows the same chair shown in FIG. 5 but with the seat fully reclined. Notice the different position of runner 31 inside the raceway 30.

Figure 7:
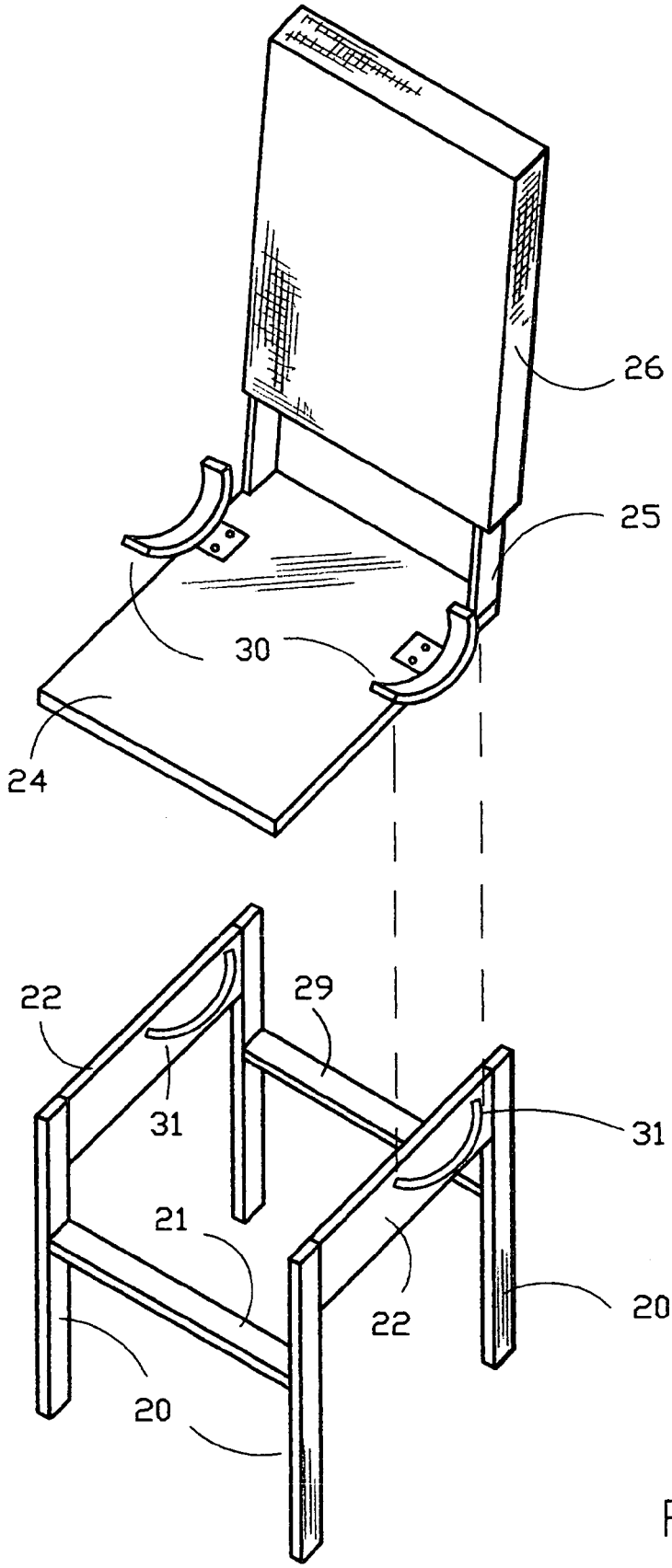
FIG. 7 is an exploded perspective view of the chair shown in FIG. 5.

FIG. 7 is a fragmentary perspective exploded view of the chair of FIG. 5.

For clarity purposes only, the fabric and foam that comprises the horizontal board 23 has been removed, leaving in place an ubiquitous panel 24 that is the structural member of said board 23.

30 are the runners, rigidly attached to panel 24. Numeral 31 are the raceways.

Figure 8:
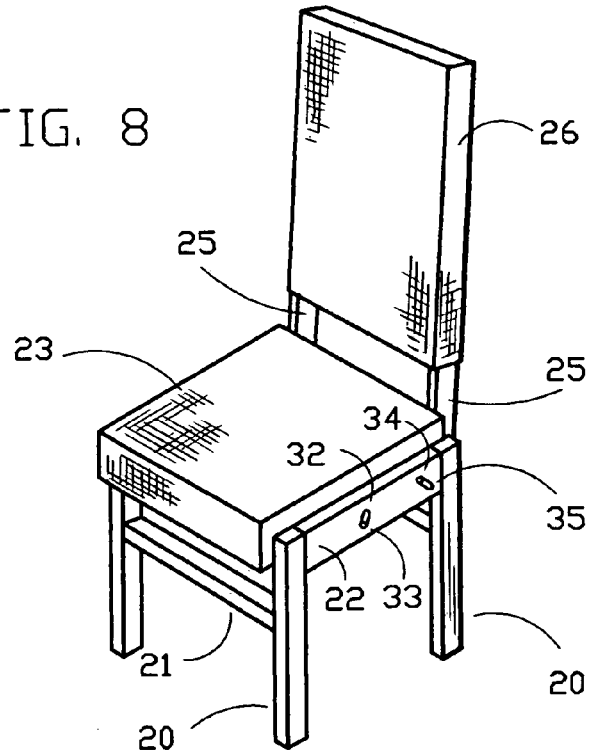
FIG. 8 is a schematic perspective view of a chair in accordance with the preferred embodiment of the present invention.

FIG. 8 chair shows the preferred embodiment of the present invention where the raceways and runners sliding surfaces had been substantially reduced in size.

Here, the raceway with a large arc, like e.g.: raceway 27 of FIG. 2 has been sliced and only the end parts of it are used, scraping the middle section. The two new smaller circular ring sectors 32 and 35 continue sharing the same diameter circle.

The runners 33 and 34 are the free ends of small diameter shafts (about 0.375" O.D.), but still rotating the same degree of arc than in previous chairs.

This plurality of smaller raceways and runners is ideal for inexpensive, small tube frames and/or expendable chairs, where space for the reclining mechanism components is always tight, and a shorter useful life is acceptable. Also, though the larger surfaces in contact of the runners and raceways of FIG. 2 and FIG. 5 make for a smoother pivoting seat, they do require very sturdy chair frames, since the right and left raceway-runner engagement have to share the same virtual axis of rotation, during the whole life of the chair. There is very little tolerance for misalignment before the runners will drag excessively and/or lock up in their raceways.

Instead, in the new embodiment, the runners, each having only a small surface of contact with their raceways, are more tolerant to some misalignment within the components.

Moreover, the raceways don't have to be perfectly circular any longer, since a system of two runners per side will always follow any curved path. For example, the raceways could now be: slightly elliptical or parabolic in its totality or at certain spots; it could even have straight sections, or the original circular path could become distorted by usage without loosing its functionality.

Though the illustration shows the raceways placed above their common center of rotation, all of above claims would also be valid if we had placed the raceways inverted, e.g. below their center of rotation, like shown in FIG. 5, FIG. 6 and FIG. 7.

Figure 9:
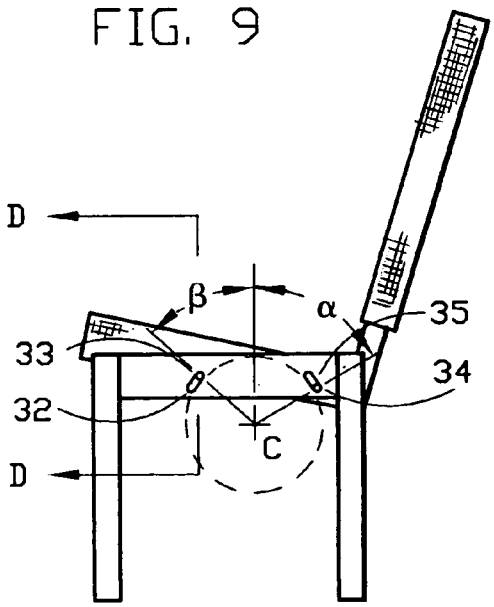
FIG. 9 is a schematic side elevation view of the chair shown in FIG. 8, with the seat in the reclined position.

FIG. 9 is a side view of the chair shown in FIG. 8. Here the seat is shown in the fully reclined position. Notice the position of the front runner 33 at the top of the raceway 32, while in the rear raceway 35, the runner 34 has moved to the lower end of the raceway. The cross-hair C is the virtual center of rotation of the seat.

Here, $\beta$ is the angle between the center of the runner 33 and a vertical line passing through C, while $\alpha$ is the angle between the center of the runner 34 and the vertical line passing through C. In this illustration de value of $\beta$ is 48°, and the value of $\alpha$ is 60°. Since the raceways 32 and 35 are placed symmetrically to a vertical line passing through the cross-hair C, the 12° difference between the $\alpha$ and $\beta$ angles is the pivoting arc of the seat. Larger $\alpha$ and $\beta$ angles increases the friction between the runners and their raceways. Though I have shown the raceways placed symmetrically to a plumb line passing through their center of rotation C, different seat requirement and the chair aesthetics may benefit from non symmetrical angular and radial placement of the raceways.

Obviously, different placement of the raceways will alter the friction factor, hence, the force required to rotate the seat between the upright and the reclined positions, and the ability of the seat to remain 'locked' in a chosen place.

Figure 10:
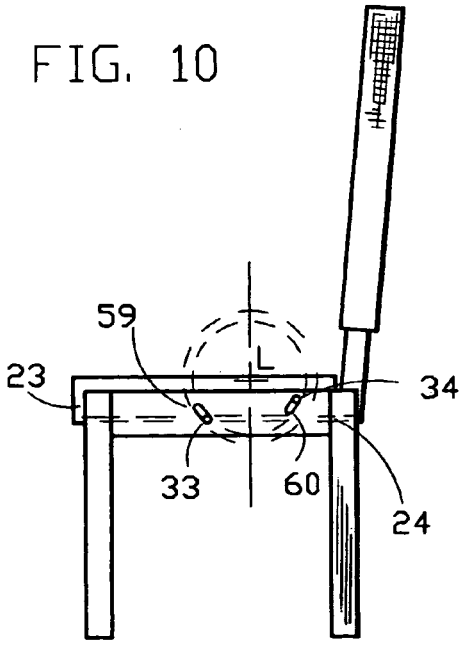
FIG. 10 is a side view of a chair similar to FIG. 8, but showing another embodiment of the present invention.

FIG. 10 is a side view of a chair similar to the chair shown in FIG. 8, with the seat in a fully upright position. The structural panel 24, shown in slashed lines, is part of the horizontal upholstered board 23.

In this embodiment the runners 33 and 34 are riding over the outer (lower) concave path of the raceways. The center of rotation of these raceways is indicated by the cross hair L, located above them.

Moreover, the front raceway 59 and the rear raceway 60 are placed asymmetrically with respect to a plumb line passing through L, besides being placed on two different concentric diameter circles.

Figure 11:
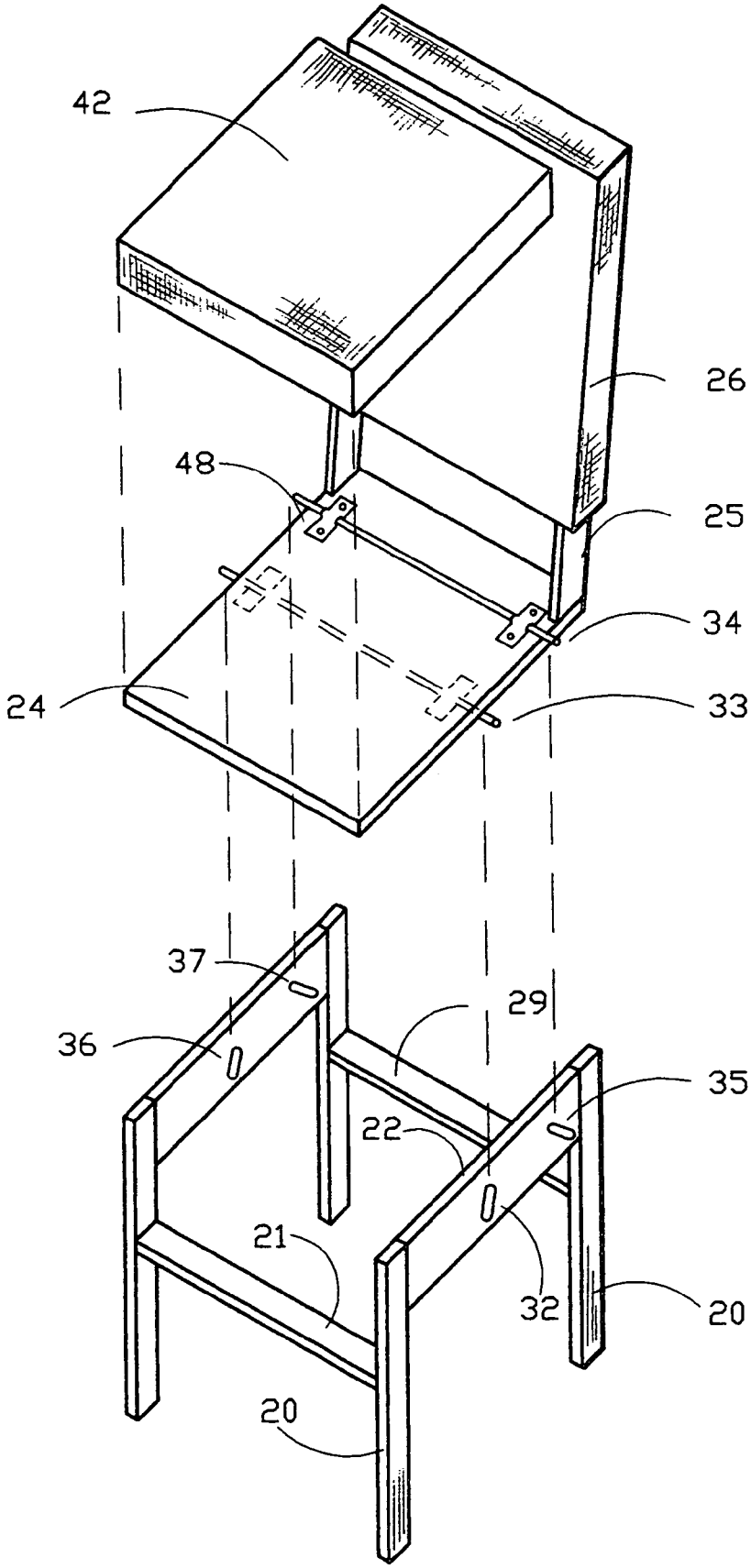
FIG. 11 is an exploded perspective view of the chair shown in FIG. 8.

FIG. 11 is a schematic exploded view of the chair of FIG. 8.

Here 42 is a foam block, part of the upholstered horizontal board 23. 26 is the back upholstered board, firmly attached to the structural panel 24 by the two rails 25.

33 and 34 are two round shafts firmly attached to the panel 24 by straps 48. The ends of these shafts function as runners that will slide inside the raceways 32, 35, 36 and 37.

Figure 12:
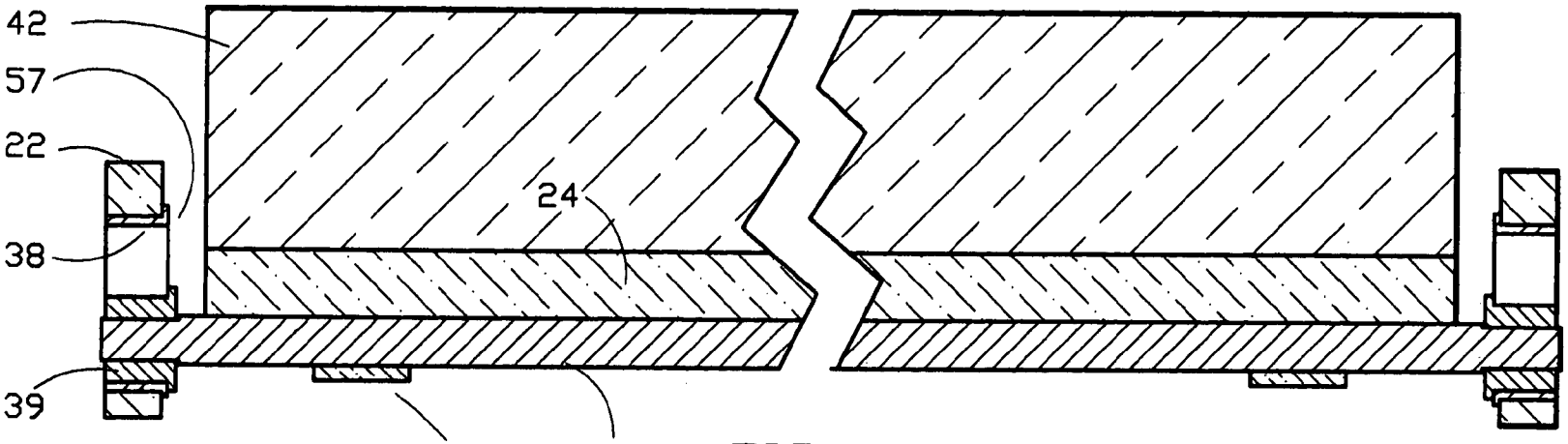
FIG. 12 is a fragmentary sectional view taken along line D—D of FIG. 9.

FIG. 12 is a cross section showing some interesting details of the raceway-runner assembly. For clarity purposes the cloth covering the horizontal board 23 is not shown. Numeral 22 is the horizontal member of the chair's frame. Fastened, glued or press fitted into the open cutout 32 is an insert 38 made of plastic or metal. At the end of shaft 33, a free rotating wheel 39—like a follower cam—rolls inside said insert 38.

A raceway lip 57, a flange on the wheel 39, plus a shoulder step on the shaft diameter checks any lateral seat motions. 48 is a clamp that attach shaft 33 to the seat panel 24. 42 is the horizontal board foam.

Figure 13:
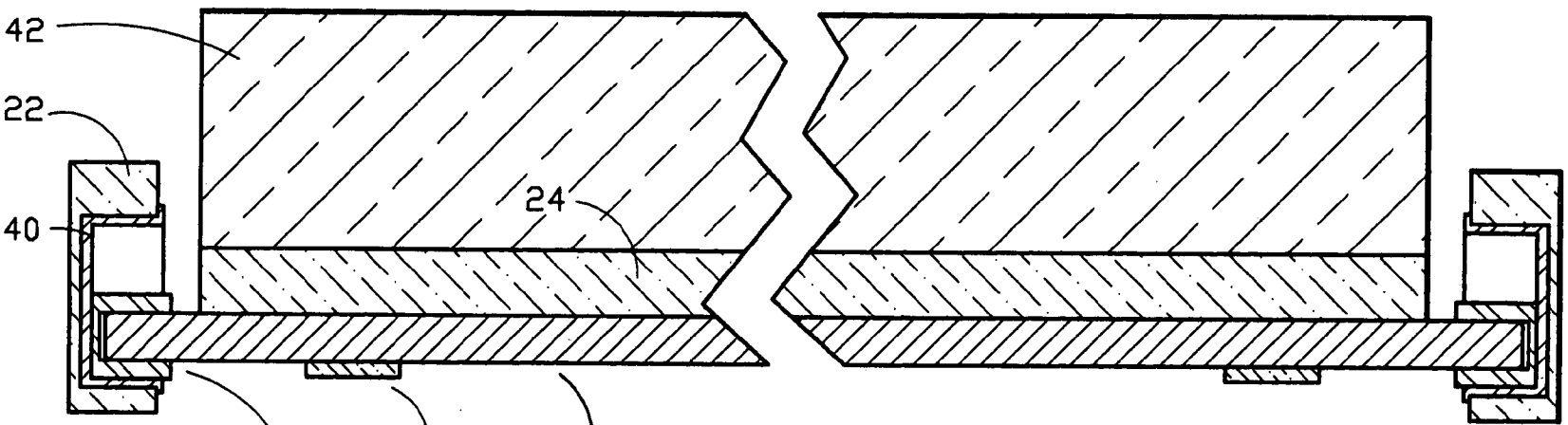
FIG. 13 is a fragmentary sectional view taken along line D—D of FIG. 9, showing still another embodiment of the invention.

FIG. 13 is another embodiment of the invention. Here, for aesthetic reasons, the raceway cutout is open only to the inside of the chair. The insert 40 is placed firmly into the closed end raceway cutout in member 22. 41 is a rotary plastic cap mounted on the end of shaft 33. The bottom wall of insert 40 and the bottom wall of cap 41 limit any lateral motion of the shaft 33, and by extension, any lateral motions of the seat on the frame, since the shaft 33 is firmly attached to the seat panel 24, by the straps 48.

Figure 14:
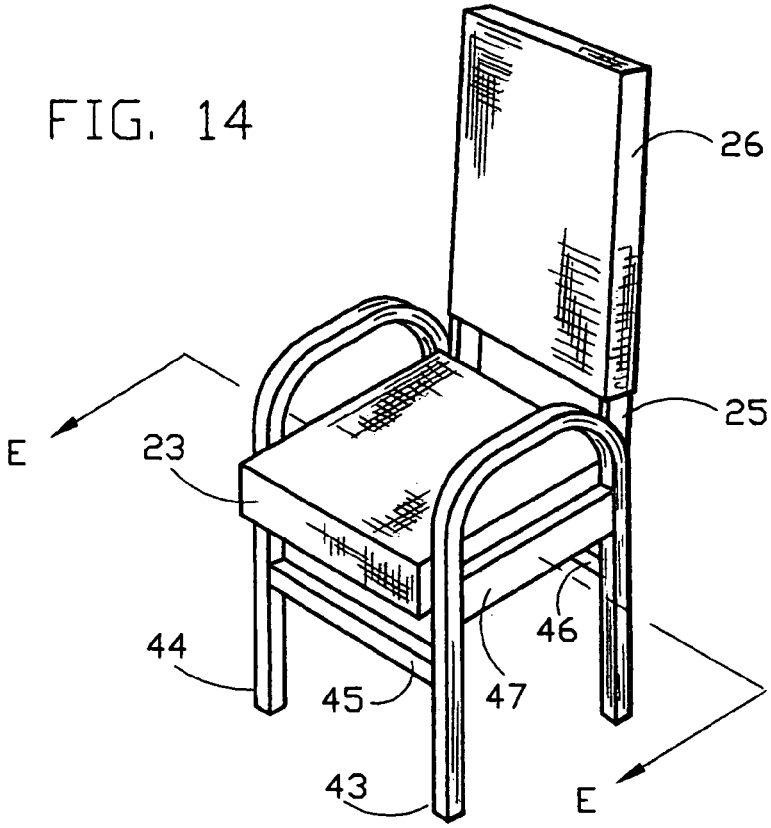
FIG. 14 is a schematic perspective view of a chair having a different embodiment of the present invention.

The chair of FIG. 14 shows yet another embodiment of the present invention, more applicable to tubular frame chairs having rest arms. Here 43 and 44 are two identical U shaped side frames, securely spaced apart by a front cross rail 45 and a rear cross rail 46. The seat comprises an upholstered horizontal board 23 and an upholstered back board 26, which are rigidly connected together to each other at an obtuse angle by the rails 25. Numeral 47 is a rectangular tubular member—housing the reclining mechanism—securely attached to the vertical members of the side frame 43.

Figure 15:
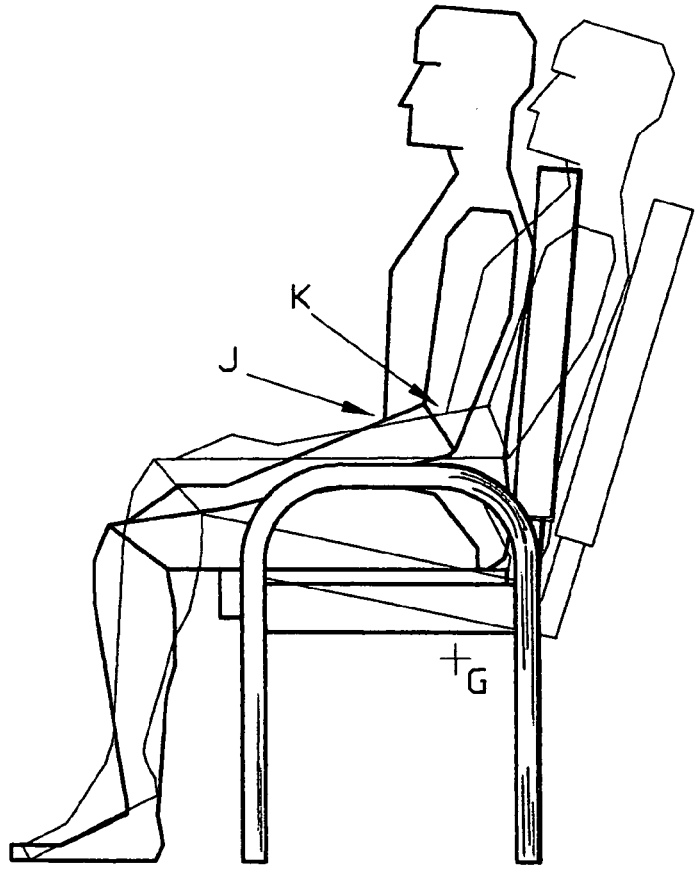
FIG. 15 is a schematic side elevational view of the chair of FIG. 14, showing the different positions of the seat-occupant entirety center of gravity when in its upright and reclined positions.

FIG. 15 illustrates the two extreme positions that a chair occupant could attain. The human silhouette sitting in an upright position was drawn in a heavier line weight than the same human silhouette sitting in a fully reclined position. The reclining angle was 12°, and the center of the seat pivoting was at the cross-hair G.

In any non motorized reclining chair, the occupant uses his legs and/or hands to change the seat position. In the most ubiquitous of the reclining chairs: the office task chairs, the chair occupant compresses a spring when he pushes the seat backwards with his legs.

The seat will remain reclined as long as the occupant keeps the spring compressed. When the occupant relaxes the pressure that he puts on the seat back board, the seat rotates forward to its upright position.

In the present invention, when the occupant pushes with his legs against the chair vertical back board, the whole seat reclines backwards while the center of gravity of the seat-occupant entirety system rises. This increase in potential energy of the system, will allow gravity, all by itself, to bring the seat forward when the occupant relaxes his push. Here, FIG. 15 illustrates the rise of said center of gravity; say point J for the upright seating silhouette, to a higher point K in space, for the reclined silhouette. Points J and K are—in this illustration—at the intersection of the figures chest and arm lines. Notice that point K would still be forward of a plumb line (not shown for clarity reasons), passing through the pivot center G. If point K where to fall behind said imaginary plumb line, the only way that the occupant could rotate the seat forward, would be by grabbing the armrest and pulling the center of gravity forward, at least until said center of gravity passes forward of said plumb line. From there, once again, the forces of gravity should bring him all the way forward, up to the fully upright seat position.

By introducing a friction factor between the raceways and the runners, we increase the acceptable effort that an occupant has to apply to recline the seat. But this friction, acting as a brake, is a must for slowing the forces of gravity that want to bring the seat forward (toward the upright position). By having the friction slowing the seat motions, the occupant may chose any forward reclining position by just releasing the pressure that he exerts against the back seat, and the seat will slowly rotate forward. The friction will also make it easier to keep a balanced seat 'locked' in place In the present invention the friction coefficients would vary with the materials used to manufacture the raceways and the runners, while different shapes and position of these runners and raceways, by exerting different forces—for the same occupant weight—over the sliding surfaces will require different amounts of efforts to pivot the seat.

If we didn't introduce a reasonably friction factor, like if the seat rotated with an extremely low friction around a ball bearing guided shaft, the seat positions would be extremely unstable, and the chair useless.

Figure 16:
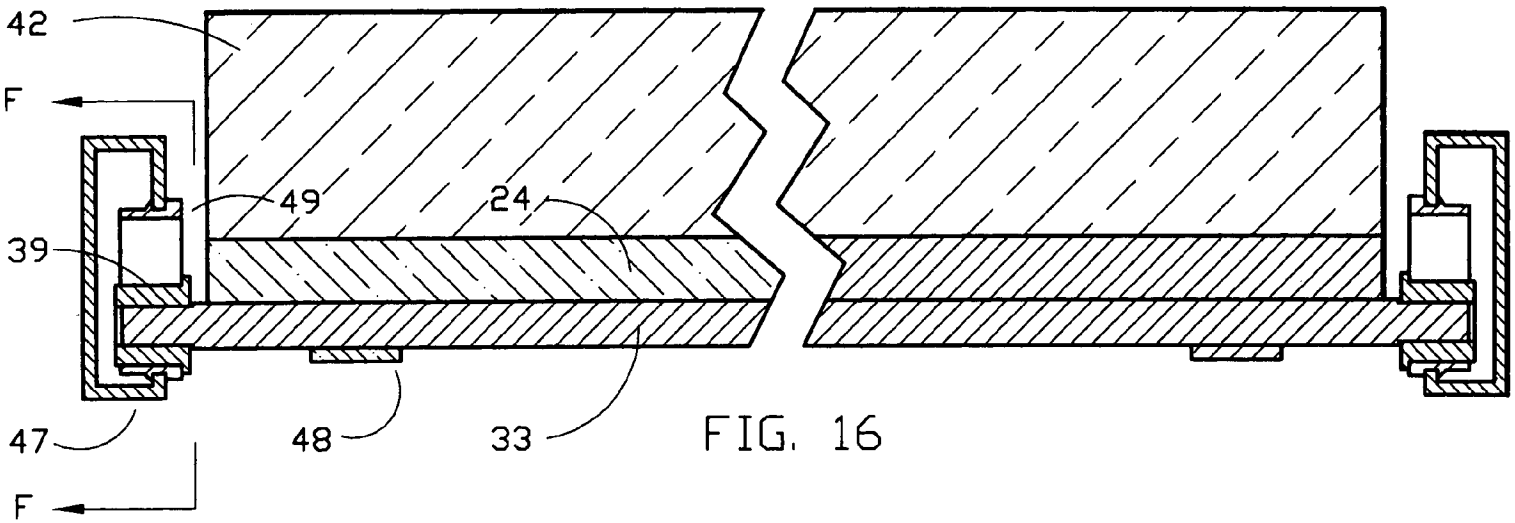
FIG. 16 is a fragmentary sectional view taken along line E—E of FIG. 14.

In FIG. 16, 33 is a shaft fastened to the panel 24 by strap 48; attached to he end of the shaft 33 we have a free rotating wheel 39. Panel 24 is part of the horizontal board 23.

The plastic insert 49 is the raceway, snapped into a corresponding hole machined on one side of the tubular member 47. On its travels, the free wheel 39 follows the inside shape of the raceway, thus tilting the attached seat accordingly.

Figure 17:
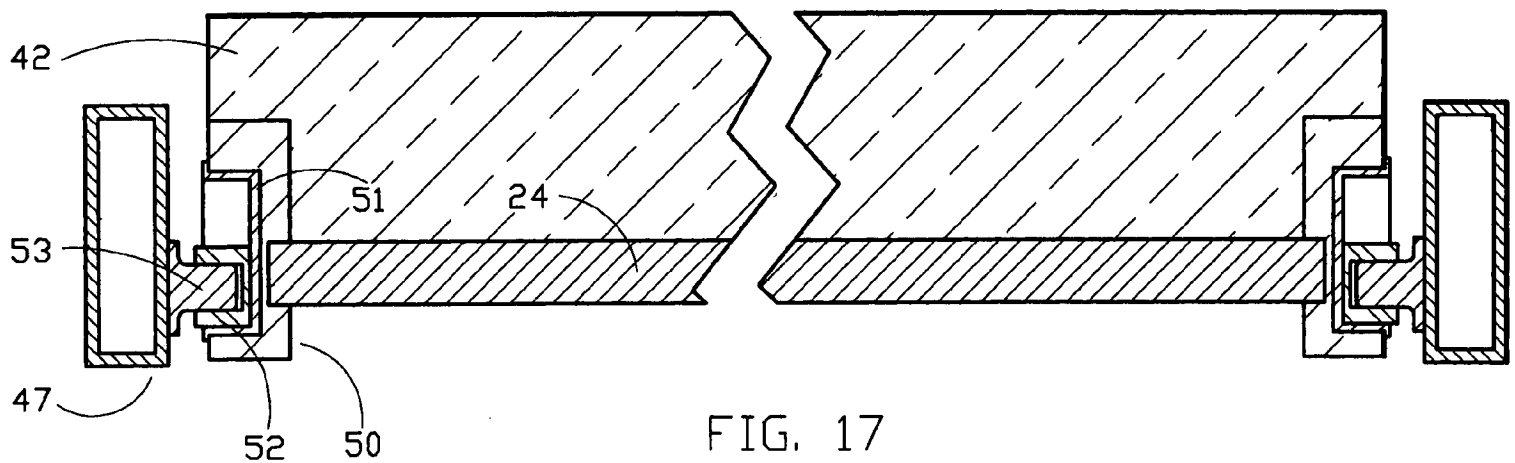
FIG. 17 is a fragmentary sectional view taken along line E—E of FIG. 14, illustrating one more embodiment of the invention.

FIG. 17 shows still another embodiment of the present invention. In this embodiment the raceways are placed on a pivoting seat, while the runners are welded to elements of the static chair frame.

Here, the raceway, represented by the plastic or metal insert 51 is glued to the wooden block 50, that in turn is glued to the seat panel 24. The runner 53 is a stud welded to the frame member 47. 52 is a plastic cap covering the stud's end.

In this embodiment the runners remain fixed while the raceways slide over them.

Figure 18:
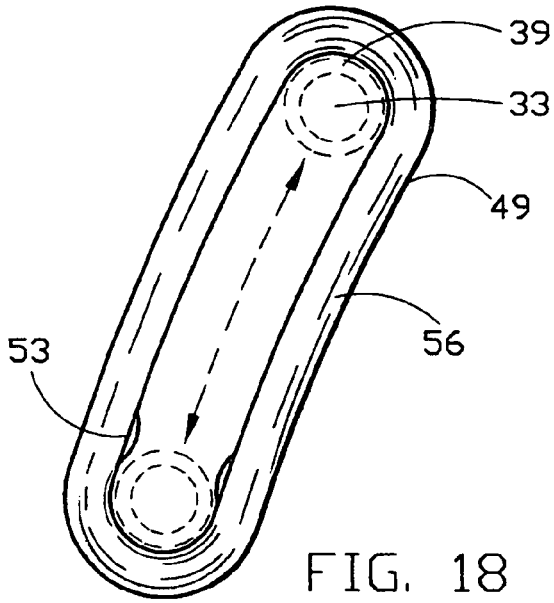
FIG. 18 and FIG. 19 are two different embodiments illustrating the front view of two different raceway inserts and their runners as seeing along line F—F of FIG. 16.

FIG. 18 is a front view of the plastic raceway 49. It is shaped like a circular ring sector with fully rounded ends. The dashed circle lines inside the raceway indicates the two extreme locations of the wheel 39.

Since a reclinable seat is always back heavy, an unoccupied seat may slowly creep backward, or the seat wouldn't stay in the upright position when the chair is moved around. This could be avoided by using a spring, as shown in prior FIG. 2, FIG. 3, FIG. 4 and FIG. 22. In a novel embodiment of this invention, this undesirable back rotation could also be corrected by molding a plurality of ridges or detents 53 inside the raceway 49 upper and lower paths. This round ridges—only a few thousands of an inch high—will stop the wheel 39 from creeping out of its bottom location. The ridges would also lessen the slamming of the runners against the raceway bottom when the seat reaches its upright position. In another instance, the detents could be replaced by a narrowing of the raceways aperture, that would create an interference with the runners, slowing the runners down, and keeping them in place. Then, only the chair occupant effort will snap the wheel out from its bottom location.

The long dashed lines 56 indicates the raceway wall thickness.

Figure 19:
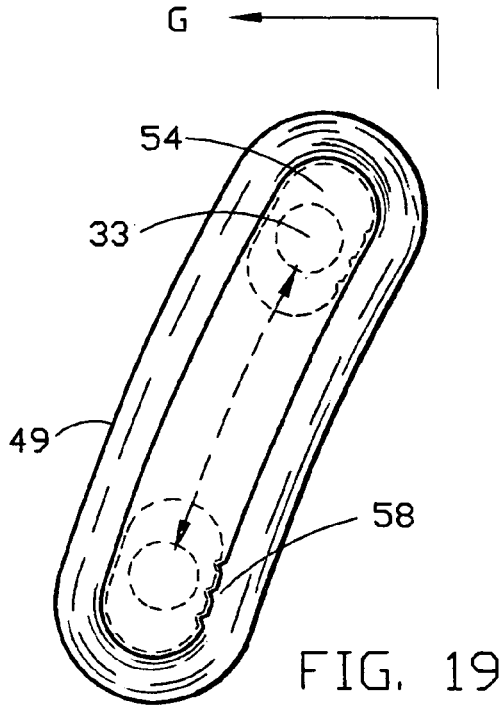

FIG. 19 shows still another embodiment of a plastic raceway. It is similar to the raceway 49 of FIG. 18, showing a plurality of ridges 58 on the raceway path. To assure a stronger retention of the front runner 54—when at the bottom of the raceway—said runner has incorporated minute matching ridges. Here, the circular dashed lines 33 is the free end of the shaft, and the elongated shape represented by numeral 54 is a cap covering said shaft end. The adoption of an elongated shaped runner, while not as smooth going as a rolling wheel, would handle larger seat loads due to its larger foot print.

Intermittently in the past, I meant—liberally—by a runner: the ends of a rod or a plastic piece that rolls, slides, coast or glides inside a raceway.

Figure 20:
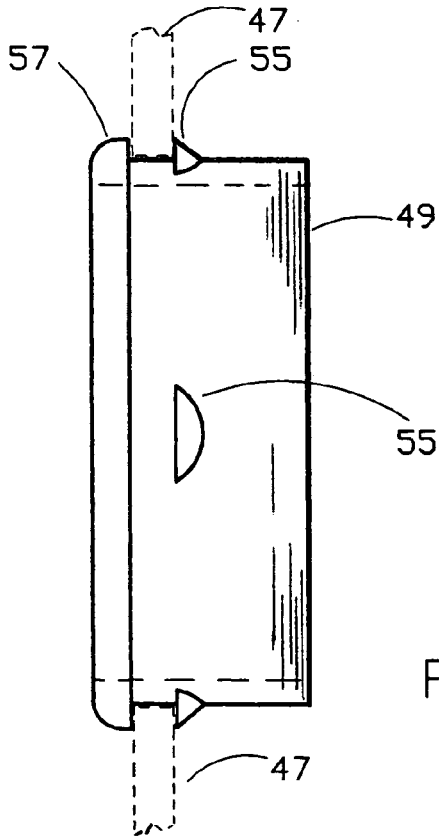
FIG. 20 is a side view taken along line G—G of the raceway shown in FIG. 18.

FIG. 20 is a side view of FIG. 19 showing how the elastic barbs 55 (molded onto the outer wall of the raceway insert), engages the walls of member 47 (shown here in phantom lines). The wall gets clamped within the flat back of the raceway lip 57 and a plurality of barbs 55, keeping the insert firmly in place.

Figure 21:
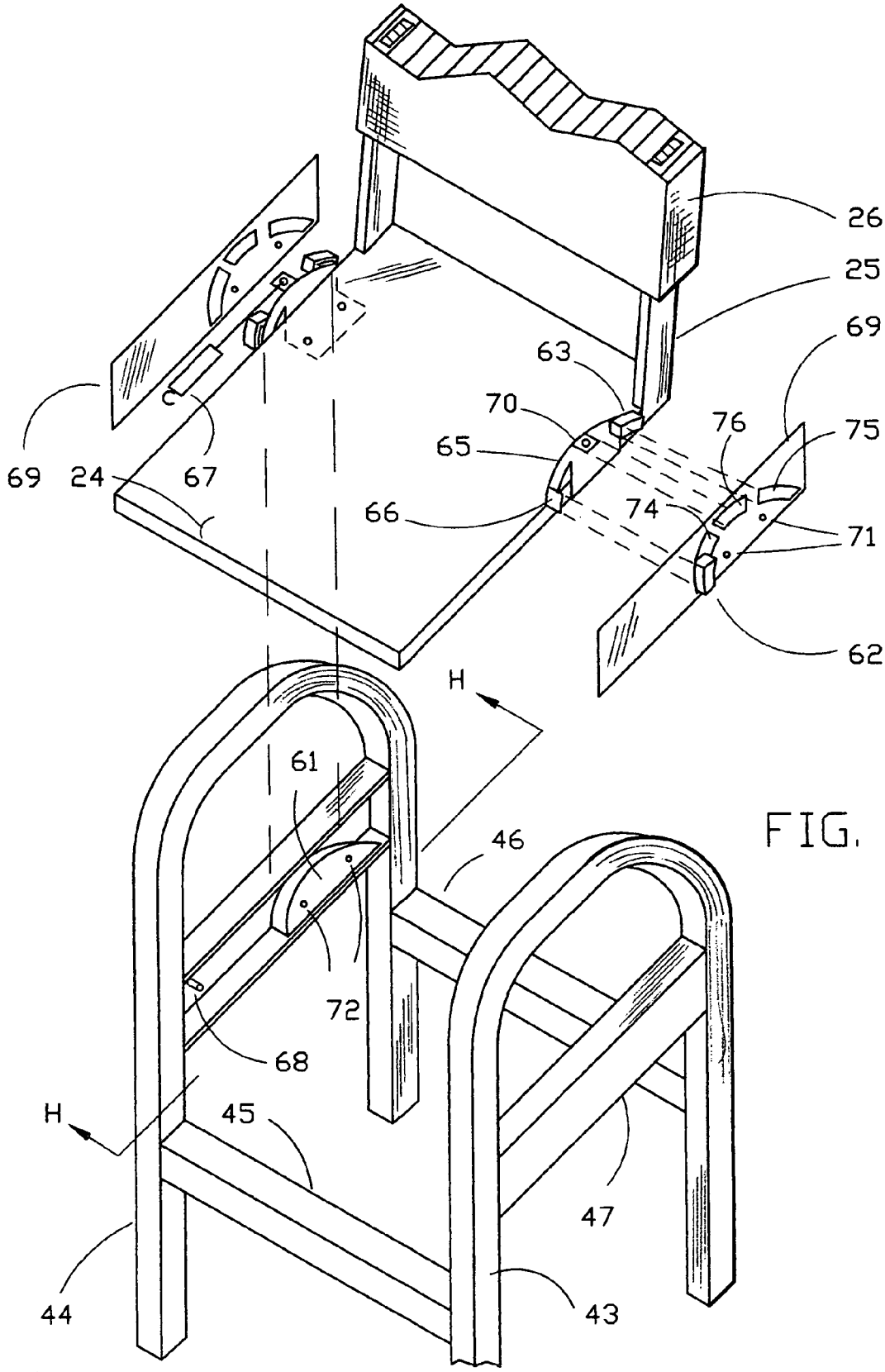
FIG. 21 is an exploded schematic perspective view of the chair shown in FIG. 14.

An alternate embodiment of this invention is illustrated in FIG. 21, an exploded partial view of the chair shown in FIG. 14. Here, the raceway 61 is a metallic or plastic circular segment attached to the inside of the horizontal member 47, a U type metallic channel. 62 and 63 are the front and rear plastic runners respectively for each side; these runners are loosely mounted on the flanges or prongs 66 of bracket 65 that is fastened to the horizontal board 24. Bracket 65, a stamped steel piece, has a plurality of flanges or prongs 66 that engage the runners through corresponding openings in one side of the runners. In this illustration each bracket has two runners, but it could have more if the raceway path is too narrow and the load on the runners become too heavy. The middle prong, numeral 70, has a small hole where an elastic element, in this case a tension spring 67—only on one side shown—engaged at one end to said prong and at the other end to the anchor 68, attached to the inside of channel 47. The function of this spring is to keep the seat in an upright position. Without the spring, since the back board of the seats are usually quite heavy, the seats could creep into an unsightly reclined position.

In an assembled mechanism the cover plate 69 is fastened to the raceway 61 by means of screws that, due to their small sizes are not shown.

Here, 71 are clearance holes for the screws and 72 are the threaded holes used for fastening the cover plate 69 to the raceway 61.

The functions of the cover plate 69 are multiple. It covers the components of the mechanism, hence, is a decorative piece. It also keeps the chair occupant's fingers out of harms ways, since the mechanism has pinching points. But a more important function would be to check the motions of the runners. In the present illustration, the openings 74 and 75 are slots concentric with the raceway(s), and having well defined ends. Its obvious that both ends of each slot could be used to stop the rotation or tilting of a smug fitting runner—and by extension since the runners are part of the seat—be the seat stops at the upright and at the fully reclined positions—in addition of other seat stops—as could be the case of the front runner 62 in the opening 74 in this illustration. In this embodiment, the cover plate 69 also checks the upward motions of the runners, since raceway 61 only has the lower path. Numeral 76 is the cover plate opening for the prong 70. The horizontal member 47 could also have been a carved wooden piece, instead of a metallic piece, if it was considered strong enough for the application.

Figure 22:
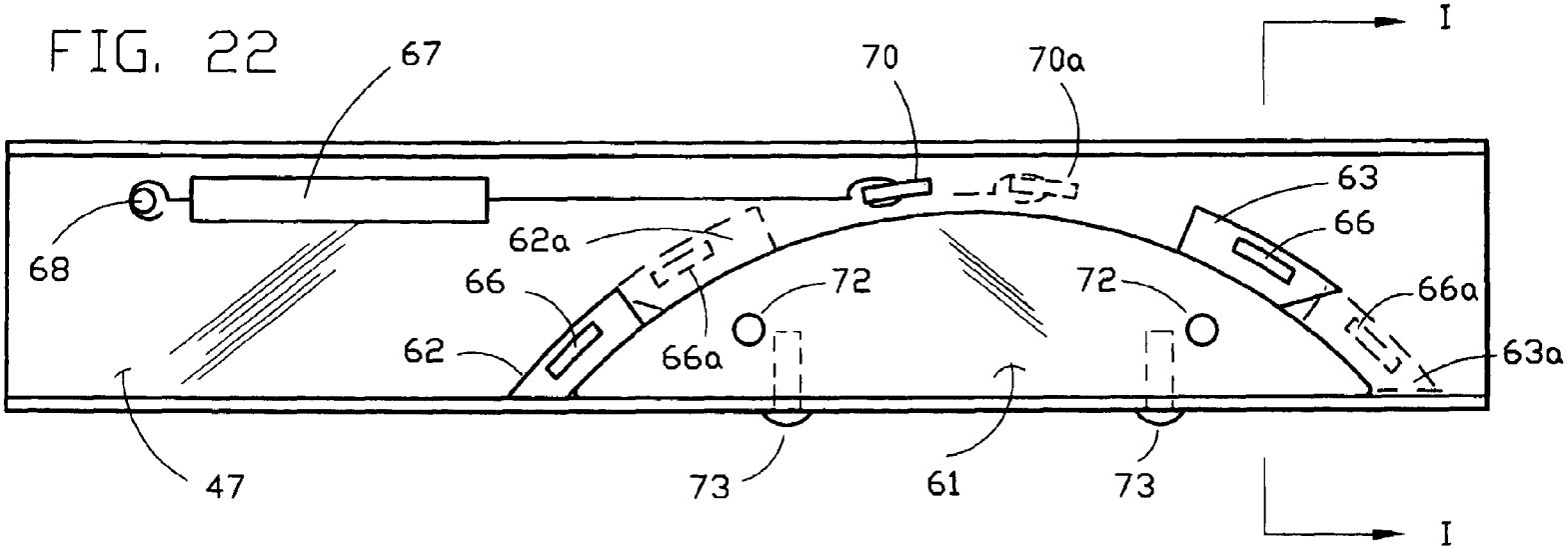
FIG. 22 is a schematic side elevational view along line H—H of FIG. 21.

In FIG. 22, a partial schematic side view, shows the location and motions of the runners and spring in an assembled reclining mechanism for this embodiment, with the cover plate 69 removed for clarity purposes only. The position of the corresponding bracket prongs are indicated by the side openings on the runners and by the spring hook.

Numeral 61 is the raceway represented by the convex arc of a circular segment fastened to the horizontal member 47 by screws 73. 62 and 63 are the front and rear runners respectively, sliding over the arc of the raceway 61. Up to now, the upper and lower paths of all the raceways were done into one piece, but in this embodiment they are found in two different pieces. The lower path is provided by the arc of the circular segment 61, that we will keep calling the raceway, and the upper path(s) are provided by the upper edges of the cover plate 69 openings that are circular rings sectors concentric with the raceway.

Here, the rectangles 66 would be the position of the prongs in the assembled mechanism. 67 is an elastic elements, e.g.: a tension spring engaging at one end the prong 70 and at the other end to the anchor 68. 72 are threaded holes used to fastening the cover plate 69.

This would be the position of the runners, prongs and spring when the seat is at the upright position. Notice here that the front runner 62 is stopped here by the inside face of the lower leg or flange of the channel 47.

Stopping the runners, or the prongs, would stop the further rotation of the seat.

In other embodiments the stops could be part of the raceway 61 or the cover plate 69.

When the seat rotates or tilts backward, the runners 62 and 63 slide backward over the raceway 61, to their reclined position shown here by the phantom lines of 62*a* and 63*a* respectively. 66*a* would be the new positions of the prongs 66. Likewise, the spring 67 is stretched to the new position 70*a* (shown in phantom lines), of the prong 70.

Notice that when the rear runner 63 reaches its 63*a* position it is stop from further traveling by its interfering with the lower flange of the channel 47, thus becoming the farther reclined position attainable by the seat.

In prior embodiments the runners were housed in slots that limited their vertical displacements. In normal operation the runners are only in sliding contact with the lower path of the raceway because the weight of the seat-occupant entirety forces always the runners downward. But it may happen when the seat is at one of the extreme positions: upright or fully reclined, that, if the chair occupant forced the seat against its stops, some runners will be forced against the upper paths of the slot. Another instance would be when the chair is lifted by the seat, pressing all the runners against the upper path of the raceways. But these vertical motions occur only in very rare circumstances, and in none of them the runners slide over the upper path of the slots. That's why in the embodiment shown in FIG. 21 and FIG. 22 the raceways could have only a lower path. For the very rare occasions where vertical motions of the runners have to be checked, a thin slotted cover plate 69, limiting the upward motions of the runners or their prongs, would suffice.

Figure 23:
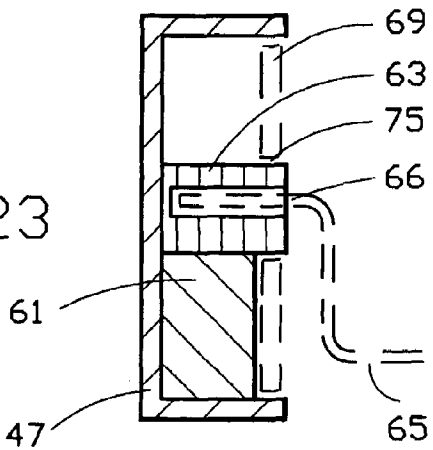
FIG. 23 is a schematical cross section along line I—I of FIG. 22.

In FIG. 23, the phantom lines illustrates the position of the cover plate 69 in an assembled unit. Here the runner 63 extends horizontally past the corresponding opening 75 of the cover. While the runner rides over the raceway 61 that would stop any downward runner motion, any runner upward motions would be checked by the upper edge of the opening 75 of the cover plate 69. The position of the prong 66 of the bracket 65 are shown here in phantom lines.

In some instances were the load on the runners is low, like in some child chairs, given enough cover plate thickness, the raceway could be eliminated and the openings or slots in the cover plates 69 becomes the raceway with its lower and upper path, and the ends of the slot becoming the upright and reclining seat stops. In this possible embodiment, the cover plate would be directly attached to the channel 47 as an insert.

Figure 24:
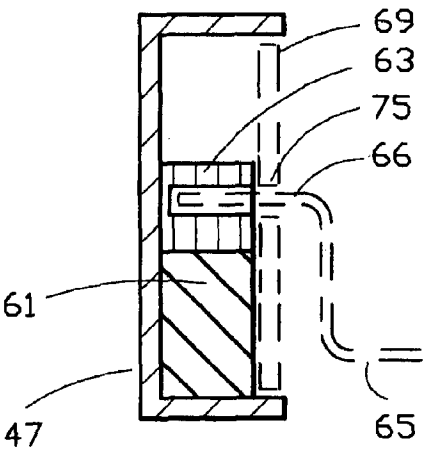
FIG. 24 is another embodiment of the schematical cross section along line I—I of FIG. 22

In another embodiment of the cover plate 69, as shown in FIG. 24, the runner 63 has the same width as the raceway 61. While the runner rides over the raceway 61 that would stop any downward runner motion, any upward motion of the runner 63 would be checked by limiting the upward motion of the corresponding prong 66 of bracket 65, shown in phantom lines. To that effect, the opening 75 on the cover plate 69 is just a little wider than the prong's 66 material thickness.

While the invention has been described with respect to a preferred embodiment, it is apparent that various changes can be made without departing from the scoop and teachings of the invention as defined by the appended claims.

What is claimed is:

1. A chair having a reclinable seat comprising in combination two supporting side frames, each side frame having at least one substantially horizontal member and substantially vertical leg members, said frames disposed in a spaced apart relationship by cross-rails, a seat disposed within said frames further having an upholstered bottom board and an upholstered back board connected together, the bottom board having front and rear edges, further comprising:

means for supporting said seat including (1) a plurality of concentric circular ring sector shaped slots located on said horizontal members, and (2) a plurality of plastic runners connected to said seat bottom board and sliding in said slots; said slots having end surfaces, the centers of said circular slots defining a virtual transverse axis of rotation of the seat;

a lining material covering the lower paths of the slots; the slot paths having detent means to moveably engage with corresponding detent means located on the runners;

a plurality of runners moveably engaged into said slots and attached onto brackets that are securely connected to the bottom board, the runners having complementary surfaces with the lower paths of the slots, the runners having end surfaces that engage said ends of the slots;

springs attached at one end to the horizontal members and at an opposite end to the bottom board forcing the runners against one of the ends of the slots, and cover plates fastened to the horizontal members having circular ring sector shaped slots concentric with the axis of rotation of the seat, the runners moveably engaged with respect to the slots of the cover plates, the ends of the slots having surfaces that stop the rotation of the runners.

2. A chair having a reclinable seat comprising in combination two supporting side frames, each side frame having at least one substantially horizontal member and substantially vertical leg members, said frames disposed in a spaced apart relationship by cross-rails, a seat disposed within said frames further having an upholstered bottom board and an upholstered back board connected together, the bottom board having front and rear edges, further comprising:

means for supporting said seat including (1) a plurality of concentric circular ring sector shaped slots located on opposite sides of said bottom board; and (2) a plurality of plastic runners attached to said horizontal members and sliding within said slots, said slots having end surfaces, the centers of said circular slots defining a virtual transverse axis of rotation of the seat;

a lining material covering lower paths of the slots; the slot paths having detent means to moveably engage with corresponding detent means located on the runners;

a plurality of runners moveably engaged into said slots and attached onto brackets that are securely connected to the horizontal members, the runners having complementary surfaces with the lower paths of the slots, the runners having end surfaces that engage said ends of the slots;

springs attached at one end to the horizontal members and at an opposite end to the bottom board forcing the runners against one of the slot ends, and cover plates fastened to the bottom board having circular ring sector shaped slots concentric with the axis of rotation of the seat, the runners moveably engaged within the slots of the cover plates, the ends of the slots having surfaces that stop the rotation of the runners.

3. A chair as described in claims 1 or 2 further comprising circular ring sector slots that are placed into inserts.

4. A chair as described in claims 1 or 2 further comprising runners having wheels.

5. A chair as described in claims 1 or 2 further comprising horizontal members having a channel shaped cross-section.

6. A chair as on claim 1 or 2 further comprising the virtual transverse axis of rotation being horizontally located four to eight inches forward of the rear edge of said seat bottom board.

* * * * *